US005481782A

United States Patent [19]

Grabber

[11] Patent Number: 5,481,782

[45] Date of Patent: Jan. 9, 1996

[54] CABINET/FURNITURE WITH SNAP-ON DEVICE FOR QUICK ASSEMBLY

[75] Inventor: Günther Grabber, Fussach, Austria

[73] Assignee: Grass AG, Hochst/Vlbg., Austria

[21] Appl. No.: 208,354

[22] Filed: Mar. 9, 1994

[30] Foreign Application Priority Data

Mar. 12, 1993 [DE] Germany ..... 43 07 882.6

[51] Int. Cl.[6] ..... E05D 7/06; E05D 7/12

[52] U.S. Cl. ..... 16/258; 16/DIG. 43

[58] Field of Search ..... 16/257, 258, 240, 16/DIG. 43

[56] References Cited

U.S. PATENT DOCUMENTS

| | | | |
|---|---|---|---|
| 4,847,948 | 7/1989 | Gross et al. | 16/DIG. 43 |
| 4,999,877 | 3/1991 | Gasser | 16/DIG. 43 |
| 5,025,530 | 6/1991 | Ferrari et al. | 16/240 |
| 5,056,190 | 10/1991 | Rock et al. | 16/257 |

*Primary Examiner*—Lowell A. Larson
*Assistant Examiner*—Donald M. Gurley
*Attorney, Agent, or Firm*—Petree Stockton

[57] ABSTRACT

A cabinet/furniture hinge with a snap-on device for quick assembly includes a hinge cup and a hinge arm, a cover clamp with an adjusting plate, and a fastening plate clamped on the base plate. Retainer surfaces formed on the front area of the fastening plate are releaseably engageable with corresponding surfaces of the base plate, and a resilient spring-biased tilted chute with a grip nose is located on a rear area of the fastening plate. For easy operation of the tilted chute, the grip nose of the tilted chute engages under a projection of the base plate and defines a space between the grip nose and a bottom edge of side projections formed on the base plate. In order to fix the fastening plate on the base plate, the fastening plate is provided with a centering socket which is closely fittingly engageable in a notch of the base plate.

8 Claims, 3 Drawing Sheets

CABINET/FURNITURE WITH SNAP-ON DEVICE FOR QUICK ASSEMBLY

FIELD AND BACKGROUND OF THE INVENTION

The object of the invention is a cabinet/furniture hinge with a snap-on device for quick assembly and more particularly a snap-on device for attaching a furniture hinge to a frame, the furniture hinge being of the type including a hinge cup mountable to a door, a swivel arm pivoted at one end to the hinge cup and connected at the other end to a cover clamp, and an adjusting plate connected to the cover clamp.

Such cabinet/furniture hinges are located on the inner side of the cabinet/furniture between the door and the cabinet/furniture. The hinge cup is thereby screwed down in a recess on the inner side of the door. A hinge with a hinge arm is provided on the hinge cup on which a hinge or swivel arm is attached. The swivel arm is formed as a cover clamp and furthermore, engages an adjusting plate and a fastening plate. In turn, the fastening plate connects in the appropriate way with a base plate which is already screwed to the cabinet.

Normally, the cabinet/furniture doors are shipped separately from the cabinet/furniture bodies. A component of the cabinet/furniture hinge is on the door and the other component of the cabinet/furniture hinge is located on the inner side of the cabinet/furniture body. When assembling the cabinets/furniture, the user must mount the doors or equivalent in a suitable manner—that is, connect the base plate to the door with the fastening plate by the swivel arm.

Such cabinet/furniture hinges are known by a previous Patent DE 37 33 700 C2 of the applicants. With this previously known cabinet/furniture hinge, the fastening plate engages with an inwardly pointing hook shaped retainer surface in which an upwardly pointing wedge surface engages a base plate, and furthermore in the area distanced from the door of the fastening plate, a tilted chute is placed that engages a backward bending catch shoulder. Grip noses are formed on this catch shoulder; whereby, this grip nose sets somewhat perpendicular on the upwardly bent slide surface of the base plate and clamps to this slide surface of the base plate.

With this prior technology, it appears that the clamping action of the grip nose to the corresponding slide surface of the base plate results collectively in a strong clamping of the tilted chute which is associated with the disadvantage that the tilted chute itself is difficult to release with finger pressure.

SUMMARY OF THE INVENTION

The purpose of the invention is to further develop a cabinet/furniture hinge with a snap-on device so that the tilted chute can be more easily operated.

A fundamental feature of the invention is that the grip nose of the tilted chute engages under a projection of the base surface; whereby, a space is provided between the grip nose and the bottom edge of the base plate side projection. Therewith, according to the invention, the sliding surface is completely omitted because it no longer results in a clamping action between the respective grip nose of the tilted chute and the corresponding sliding surfaces of the base plate.

Instead the invention provides that a projection with a pitch is formed in the rear area of the base plate; whereby, the grip nose does not come in contact with this pitch when the tilted chute is operated. According to the invention, the grip nose reaches, after the contact-free passing of the pitch, the area of the back edge of the projection, and there defines a space to the bottom edge of the base plate side projection.

This is tied to the advantage that it no longer results in a clamping engagement of the tilted chute and the base plate, but instead, the grip nose grips only to securely position the fastening plate under the base plate and hereby results in a clearance. So it no longer results in a clamping of the gripping nose with the bottom edge of the base plate side projection and especially not with the pitch. Therefore, the tilted chute is easier to operate.

Another significant feature of the submitted present invention is that an exact fitting centering is formed between the base plate and the fastening plate to fix the fastening plate on the base plate. This exact fitting centering is a form-fitting engagement of the distance plate in the base plate; whereby, the base plate inserts a notch which a centering socket of the fastening plates engages form-fitting.

In this notch are advantageously at least two opposing shoulders which lie in lengthwise direction of the base plate on which the centering socket fits.

In a preferred embodiment, the centering socket rests form-fitting on all sides of the notch; whereby, the centering socket, dependent on its exact fitting engagement in the notch, is unequivocally fixed on the base plate and is securely inserted in the notch by the operative radial forces of the shoulder.

The applicant's tests have revealed surprising results: with the help of the exact fitting clamping of the centering socket in the notch of the base plate, together with the hook shaped retainer surface on the front end of the base plate, a secure and simple-to-operate snap-on device can be made with which the tilted chute can be easily released with finger pressure.

The basis of the submitted invention results from not only the matter of the individual patent claims, but also the various combinations of the individual patent claims. All records, documents and evidence, inclusive of the summary, open and disclosed statements and declaration, especially those represented embodiments in the drawings, will be claimed as fundamental and significant inventions, as far as the claims individually or in combinations are relative to the position that the technology is new.

The invention at hand will be explained more precisely by the various embodiments shown by representational drawings. Hereby, additional significant features and advantages of the invention will be concluded from the designs and their descriptions.

DESCRIPTION OF THE PREFERRED EMBODIMENT

Figure 1:
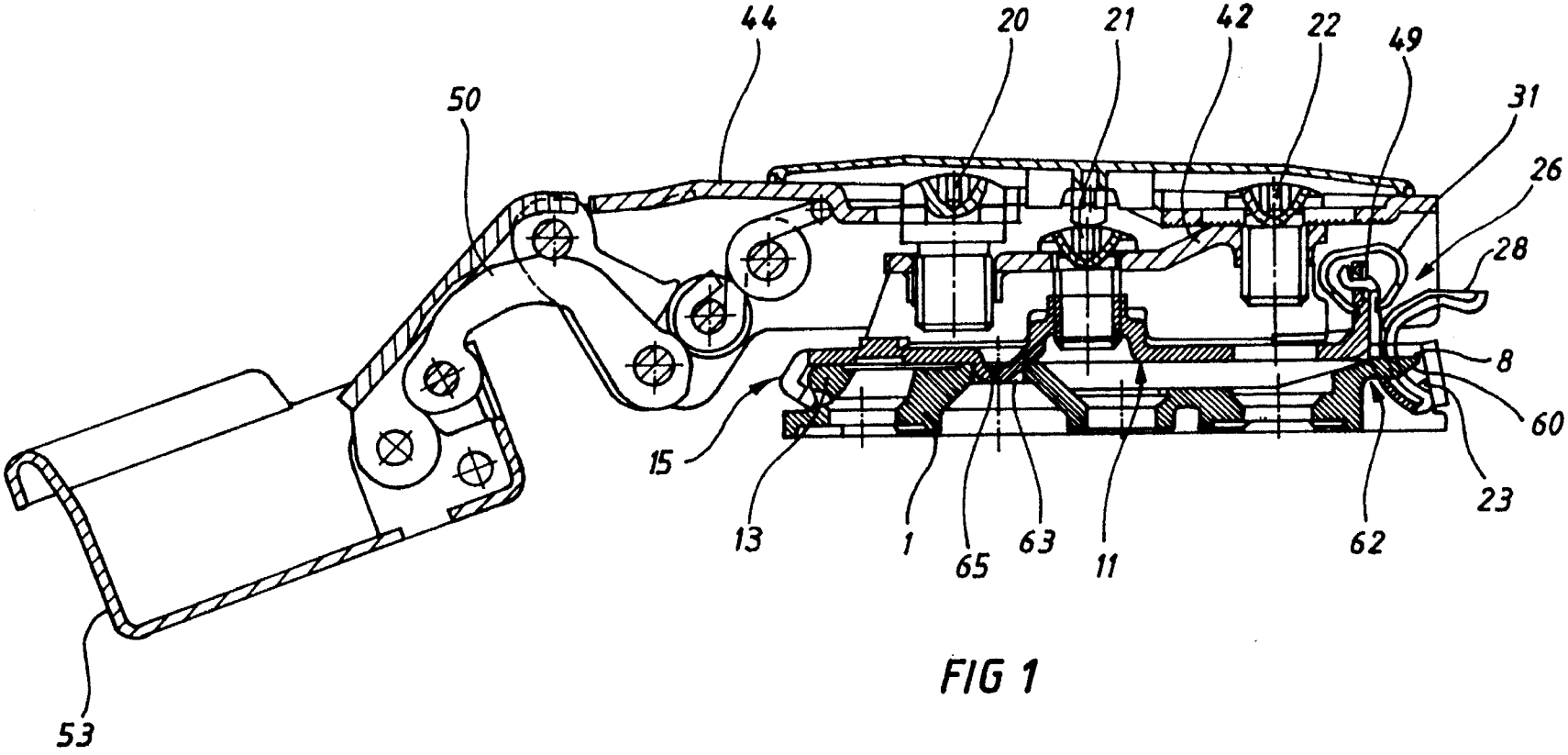
FIG. 1: an embodiment of the cabinet/furniture hinge according to the invention, a longitudinal section in the assembled state.

A cabinet/furniture hinge in FIG. 1 represents the hinge after it is hung on the base plate (1) and clipped on. The base plate (1) is screwed on the side wall of the cabinet by means of fastening screws and the hinge is anchored to a door with the hinge cup (53).

The swivel arm (50), which is located hinged on a cover clamp (44) projects from hinge cup (53). The cover clamp (44) advantageously inserts lateral flanges, which cover the hinge components placed on the inner side of cover clamp (44).

Furthermore, cover clamp (44) is fastened by means of respective fastening screws (20,22) to an adjusting plate (42), which in turn, is screwed on a fastening plate (11) by means of an additional adjusting- and fastening screw (21).

Accordingly, the hinge cup (53) forms with the hinge arm (50), as well as the cover clamp (44) with the adjusting plate (42) and the fastening plate (11), a unit in the form of a hinge which connects with the base plate (1).

Moreover, the front area of the fastening plate (11) has an inwardly directed hook (15), which engages with a corresponding hook shaped retainer surface (13) on corresponding surface in the front area of the base plate (1).

Figure 2:
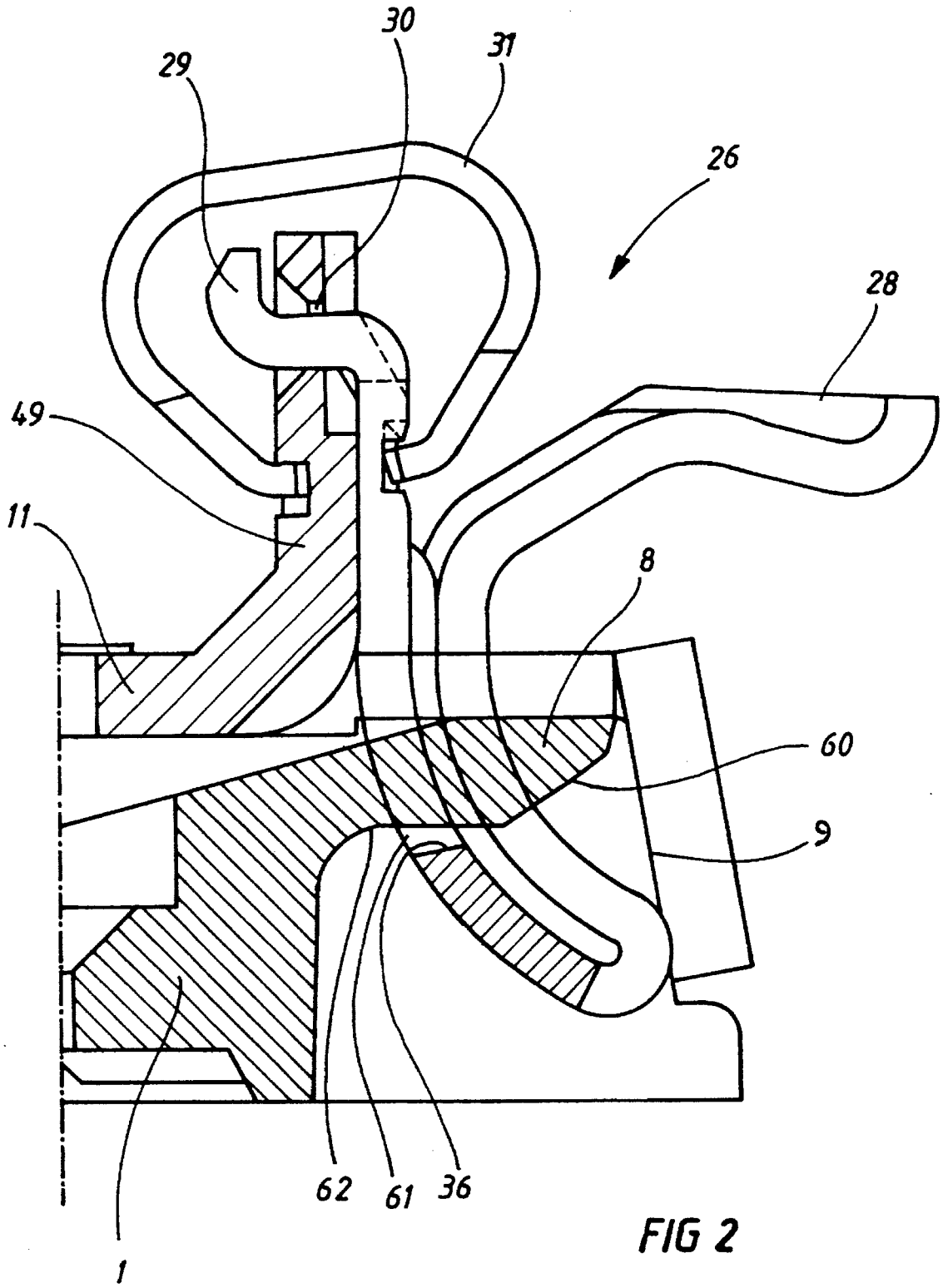
FIG. 2: a detail, according to FIG. 1 to represent the snap-on device of the base- and fastening plates by means of the tilted chute.

On the opposing end the fastening plate (11) has an upwardly projecting shank (49) on which, according to FIG. 1 and FIG. 2, a tilted chute or tilt member (26) is resiliently biased by means of a spring element (31).

The spring element (31) projects into a groove of the shank (49) and a groove of the tilted chute (26).

As represented in FIG. 2, the tilted chute (26) has an actuating lever (28) which can be resiliently deflected relative to the shank (49). The tilted chute also has a grip nose (36), which engages in the area of the bottom edge of the base plate side projection (8), and there defines a space (61) between the bottom edge (62) of the projection (8) and grip nose (36).

The tilted chute (26) located on the fastening plate (11) with bent grip shank (29) engaged through an opening (30) of the shank (49), and is resiliently secured by the spring element (31).

The fundamental basis of the invention is therefore, that the rotating radius of the grip nose (36) is selected large enough, that when the tilted chute (26) is activated, the grip nose (36) passes by, but without contacting, a pitch (60) provided on projection (8) of the base plate (11).

Figure 3:
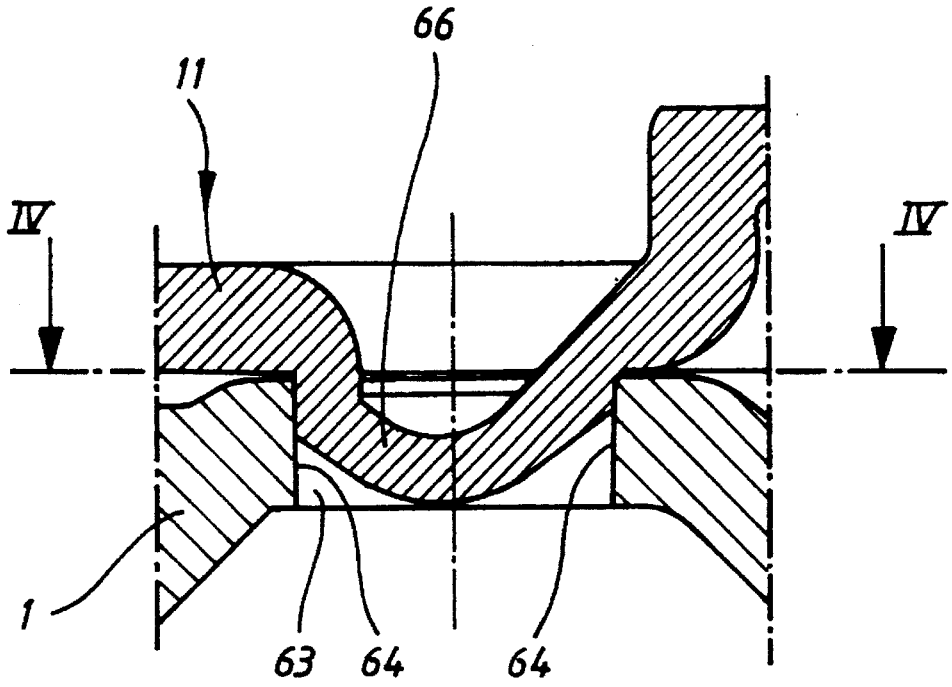
FIG. 3: a detail according to FIG. 1 to represent the exact fitting centering.
Figure 4:
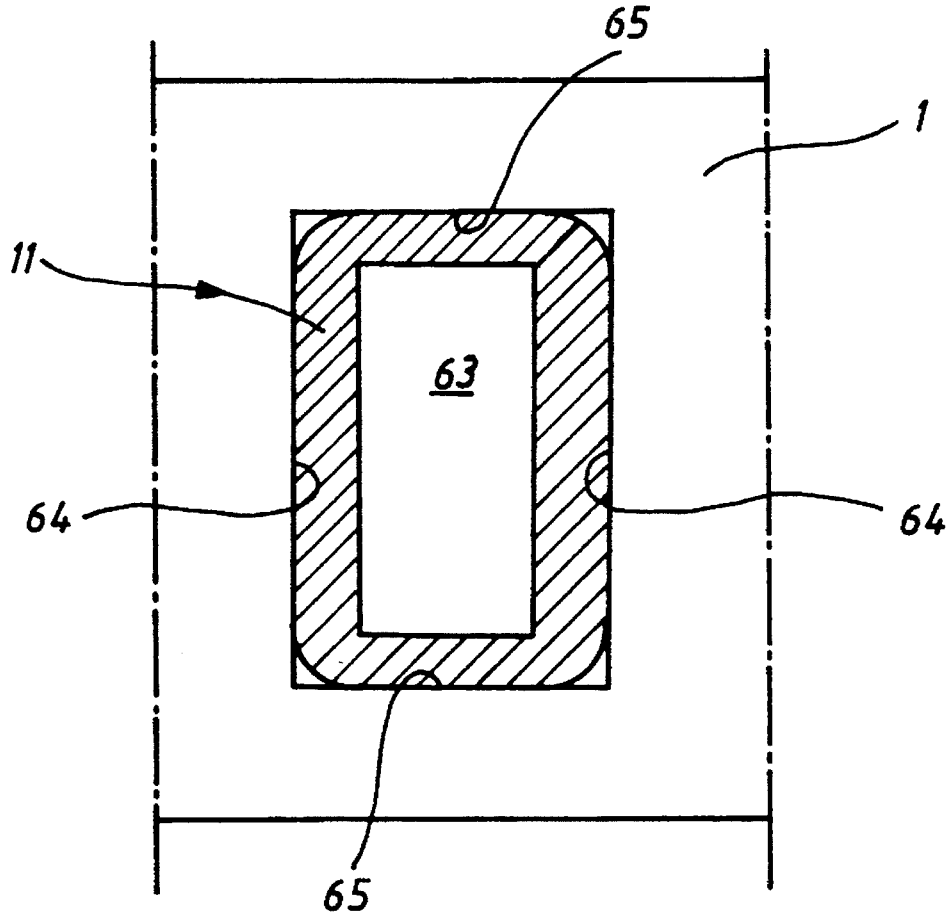
FIG. 4: a sectional view of the exact fitting centering along the sectional development IV in FIG. 3.

In the area between the front end of the base plate and the shank (49) on the back end of the base plate, as embodied in FIGS. 1, 3 and 4, in order to fix the fastening plate (11) on the base plate (1), there is a form-fitting engagement between both these plates. Thereby, the base plate (1) has a notch (63), which is rectangularly formed in the submitted design example. This notch forms four equally high shoulders; whereby, at least two of these shoulders are in lengthwise direction of the base plate facing opposite each other. Preferably, the two additional shoulders are formed in the width wise direction of the base plate (1) facing opposite each other. A centering socket or centering member (66) of the fastening plate (11) lies on these shoulders (64 and 65) of the notch (63). Moreover, the side surfaces of the centering socket (66) are produced in such a way that they fit exactly to the dimensions of the notch, so that centering socket (66) can be pressed in in the notch (63) by the application of pressure and so, by the action between the centering socket (66) and the shoulders (64,65), operating contact force centers and fixes in a stabilizing manner the fastening plate (11) on the base plate (1).

As shown in FIG. 4, the corners of the inserted centering socket (66) in the notch (63) are rounded, in order to simplify the insertion of the centering socket (66)in the notch (63).

A secure and stable grip of the centering socket (66) in the notch (63) is further supported by the present embodiment in that the base plate (1) consists of zinc, but then the fastening plate (11) is made of steel. On the one hand, by the pairing of these materials, the fit can be manufactured economically and exactly; whereby, on the other hand, comparatively large contact force can be obtained between the centering socket and the shoulders (64,65).

The hinge, as a unit, is fastened now together with the fastening plate (11) which follows with the base plate (1):

The hook (15) of the fastening plate (11) is hanged on the corresponding opposite surfaces of the base plate (1) and then the fastening plate (11) is pressed down in a swiveling movement with the hook fastening as a pivot in the direction of the base plate (1), first until the tilted chute (26) lies on the back end of the fastening plate (11) on the projection (8) of the base plate (1). In this position the centering socket (66) already partially engages in the notch (63).

By lifting the actuating clamp (28) of tilted chute (26) up until the grip nose (36) is swiveled out over the projection (8) of the base plate (1), the fastening plate (11) can now be further swiveled in the direction of the base plate (1) until they finally lie upon one another.

Hereby, by increasing the pressure on the centering socket (66) in the notch (63), the fastening plate (11) is aligned and centered in its location relative to the base plate (1), until it finally and unequivocally is fixed on the base plate by means of an exact fitting engagement of the centering socket (66) in the notch (63) and the additional exact fitting engagement in the front area of the fastening plate, namely the hook (15), unequivocally fixed on the base plate (1).

The actuating lever (28) can only spring back in its initial position; whereby, its grip nose (36) passes over, but without contacting, the pitch (60) and comes to a resting position with a space (61) to defined between the bottom edge (62) of the base plate side projections (8) and grip nose (36). The tilted chute (26) then is hooked and secured laterally behind the wedge surface (9) of the base plate with wedge surface (9) in contact with inclined surface (23) of fastening plate (11) so the fastening plate (11) is prevented from lifting by the base plate (1). Thus, the tilted chute (26) serves as protection of the fastening plate (11) when it is clamped on the base plate (1). The tilted chute (26) can nevertheless, be operated effortlessly by hand because its grip nose (36) is not jammed with the base plate.

What is claimed is:

1. A snap-on device for attaching a furniture hinge to a frame, the furniture hinge being of a type including a hinge cup mountable to a door, a swivel arm pivoted at one end to the hinge cup and connected at the other end to a cover clamp, and an adjusting plate connected to the cover clamp, the snap-on attaching device comprising:

a base plate having front and rear areas and mountable to said frame, the base plate having a retainer surface formed on the base plate front area and a wedge surface formed on the base plate rear area and having centering means disposed between the base plate front and rear areas, and the base plate having a projection with a bottom edge disposed on the base plate rear area; and a fastening plate having front and rear areas and connectable to said adjusting plate, the fastening plate having means disposed on said fastening plate front area for releaseably engaging the base plate retainer surface and means disposed on the fastening plate rear area for engaging against the base plate wedge surface and having centering means disposed between the fastening plate front and rear areas engageable with the base plate centering means, and the fastening plate having a spring biased tilt member disposed on the fastening plate rear area, the tilt member having a grip nose releaseably engageable under the base plate projection with the grip nose spaced from the bottom edge of the base plate projection.

2. The snap-on device as claimed in claim 1, wherein said centering means of said base plate comprises a notch formed in the base plate, and said centering means of said fastening plate comprises a centering member extending from the fastening plate and closely fittingly engageable in the notch, whereby the centering member is restrained firmly in the notch.

3. The snap-on device as claimed in 2, wherein said base plate has a lengthwise axis extending between said base plate front and rear areas, said notch is defined at least in part by a first pair of opposing shoulders each extending in a direction perpendicular to the base plate lengthwise axis, and said centering member rests on the first pair of shoulders when engaged in the notch.

4. The snap-on device as claimed in claim 3, wherein said notch is further defined by a second pair of opposing shoulders each extending in a direction parallel to said base plate lengthwise axis, and said centering member rests on both of said pairs of opposing shoulders when engaged in the notch.

5. The snap-on device as claimed in claim 4, wherein said notch defines a substantially rectangular opening and the centering member having four rounded corners for facilitating engagement of said centering member in the notch.

6. The snap-on device as claimed in claim 5, wherein said means for releaseably engaging the base plate retainer surface comprises a hook formed on said fastening plate front area.

7. The snap-on device as claimed in claim 6, wherein said means for engaging against the base plate wedge surface comprises an inclined surface formed on said fastening plate rear area.

8. The snap-on device as claimed in claim 7, wherein said fastening plate is made of steel and said base plate is made of zinc.

* * * * *